US005908266A

United States Patent [19]

Miller

[11] Patent Number: 5,908,266

[45] Date of Patent: Jun. 1, 1999

[54] FLOW DRAIN

[76] Inventor: Lyle E. Miller, 39 Cargall Dr., Bella Vista, Ark. 72714

[21] Appl. No.: 08/934,485

[22] Filed: Sep. 19, 1997

[51] Int. Cl.[6] ..... E02B 11/00; E02B 13/00; E01C 11/22; E01F 5/00

[52] U.S. Cl. ..... 405/41; 405/43; 405/36; 404/2

[58] Field of Search ..... 404/2, 4; 405/36, 405/40, 41, 43

[56] References Cited

U.S. PATENT DOCUMENTS

| | | | |
|---|---|---|---|
| Re. 32,248 | 9/1986 | Blecher . | |
| 3,815,213 | 6/1974 | Evans et al. . | |
| 4,273,466 | 6/1981 | Trahan, Sr. et al. . | |
| 4,365,911 | 12/1982 | Rossberg . | |
| 4,490,067 | 12/1984 | Dahowski . | |
| 4,553,874 | 11/1985 | Thomann et al. | 404/4 |
| 4,640,643 | 2/1987 | Williams . | |
| 4,815,888 | 3/1989 | Stegmeier . | |
| 4,940,359 | 7/1990 | Van Duyn et al. | 405/118 |
| 5,024,550 | 6/1991 | Mainville | 404/4 |
| 5,026,202 | 6/1991 | Thomann . | |
| 5,281,052 | 1/1994 | Beamer | 405/119 |
| 5,380,121 | 1/1995 | Schluter . | |
| 5,437,138 | 8/1995 | Tuohet et al. | 52/741.1 |
| 5,443,327 | 8/1995 | Akkala et al. . | |
| 5,454,663 | 10/1995 | Stegmeier . | |
| 5,529,436 | 6/1996 | Meyers . | |
| 5,564,857 | 10/1996 | Schluter . | |
| 5,647,689 | 7/1997 | Gunter | 405/36 |
| 5,647,692 | 7/1997 | Gunter | 405/119 |

*Primary Examiner*—Terry Lee Melius
*Assistant Examiner*—Gary S. Hartmann
*Attorney, Agent, or Firm*—Head, Johnson & Kachigian

[57] ABSTRACT

Below ground drain and conduit member to receive surface water. The member comprises two (2) extruded plastic assemblies that are joined together to form one (1) unit. This unit assembly is attached to a plastic carrier pipe, in a longitudinal fashion. The unit assembly is attached to the carrier pipe by a chemical welding process or other means.

6 Claims, 6 Drawing Sheets

A–A

FLOW DRAIN

BACKGROUND OF INVENTION

The present invention relates generally to water run-off collected in sheet flow into a special drain. The invention has particular utility in any construction which requires surface water from roadways, parking lots, swimming pool decks, etc. essentially be completed drained away. The open portion of the drain is placed level with, or slightly below, the ground or paved surface, so that water will flow through the opening and into the attached drainpipe, which is installed below the ground.

A variety of drains to carry away water are known. U.S. Pat. No. 3,815,213 to Evans, et al, disclosed, generally, drains which include a lower pipe section which has a longitudinal opening along on the upper side to form a slot in which a slotted grate is attached. The grate is formed by placing a pair of spaced plates, firmly attached, to either side of the longitudinal slot. Spacers, of multiple arrangements, are secured to the inside of each plate. These spacers comprise either solid cross-bars, which extend perpendicularly to the axis of the pipe, or a sinusoidal plate, which goes between the two (2) side plates. The plates and spacers were attached by traditional metallic welding processes. The grate is hot-dipped galvanized after fabrication. The grate is attached to galvanized pipe by metallic welding. The weld scar is repaired by applying a zinc-rich paint.

Since the '213 patent to Evans, there has been variations of slotted drains. In U.S. Pat. No. 5,380,121 to Schluter, it was disclosed a grate assembly that could be collapsible or expandable, in which to adjust for specific height requirements. The grate portion is welded, by traditional metallic processes, to a longitudinal slot in the lower pipe assembly. The grate portion comprises an upper grate portion and a lower grate portion, which are moveably fixed to one another. The grate portion is then metallic welded to the lower pipe assembly. The weld scar is covered with zinc-rich paint.

In U.S. Pat. No. 4,490,067 to Dahowski, the invention discloses a modular draining system which comprises a single piece of plastic extruded in the shape of a pipe during assembly. This assembly is pre-fabricated with little or no modification at the construction site.

Although there have been a number of drain structures disclosed, they suffer from a number of disadvantages. A number of prior drain structures involved welding metal grate portions to metal drain portions. Weather, chemicals and non-galvanizing after fabrication has a corrosive effect on metal, and, in time, may destroy the welded bond between the grate portion and the pipe portion, thus causing the drain system to be unstable. In an attempt to overcome this disadvantage, the '067 patent to Dahowski discloses a single piece drain assembly made of extruded plastic. The disadvantage with this invention is that it does not allow for any modification to the drain assembly for height adjustment. Also, size limitations of extruded full scale finished product would be impractical beyond small diameters.

The prior drainage systems either do not adequately address the concerns surrounding the corrosiveness of the welded bond by water and chemicals or, when attempting to address this problem, go to the other extreme, and do not allow flexibility in the assembly and construction of such a drain assembly. It is thus apparent that a need exists for an improved, drain assembly which permits flexibility in the assembly thereof, yet addressing the concerns dealing with the corrosive nature of water, chemicals and the welding bond as well as the durability of the entire system. Additionally, a system adaptable over a wide range of diameters is needed in the market place. This invention will span 4" through 18" and easily modified to go larger.

SUMMARY OF INVENTION

The present invention provides an improved drain assembly system, whose components is provided totally of chemical and weather resistant plastic. The assembly comprises two (2) extruded plastic sections that are joined together to form one unit by introducing spacers on designated distances. This unit assembly is attached to a plastic carrier pipe which has been prepared with a designated longitudinal section removed to form a longitudinal slot. The extruded assemblies include a vertical portion and a curved portion, referred to as a skirt portion. The assembly is attached to the prepared carrier pipe.

A lower part of the vertical portion projects into the plastic carrier pipe to a depth of at least to pipe wall thickness. This insures a transfer of ring compression for the plastic carrier pipe. The skirt width is wide enough to reinforce the carrier pipe, and extends a distance to provide bonding and reinforcement of the plastic carrier pipe. Further, since the assembly is in the form of a single piece of extruded plastic, there is no weld seams or other metal on metal to contend with. Thus, the invention eliminates the concerns surrounding corrosion and long term durability.

The unit is attached to the plastic carrier pipe by a chemical welding process. Self-tapping stainless steel screws may be used to draw the skirt into contact with the plastic carrier pipe and to hold the unit in place during the curing time of the weld.

The extruded assemblies can be of various lengths but a standard length would be used in standard production. The joining of sections would be done by using standard sleeve couplings that are cut in half, and are chemically welded to permit the drain assembly to be butted together for a tight and continuous grate assembly. The leg heights of the assemblies can be made in a variety of heights. Conversely, the assembly can be made taller, using sheared strips separated by small diameter or heavy wall pipe cut to specific lengths and held in place with stainless steel bolts. The assembly can be either increased in height or the slope of the drain can be adjusted by solvent welding strips of plastic to the inside of the assembly. Where surface traffic would dictate, spacers can be installed in the stacking portion as well.

In the event that a guard is needed to be placed over the opening, the drain assembly is capable of different methods of supporting such a guard. The assembly would allow for manipulation of the spacer height coupled with the use of stainless steel bolts in which to support a guard being placed on the top portion of the assembly. The spacers would also be able to support the weight of the guard which could be placed inside the assembly. Further, internal supports can be chemically welded or hot welded to the inside of the vertical portion of the assembly. The guard would then be able to rest upon those supports. A method for inserting spacer units into a prepared groove is available and preferred. This groove allows spacers to be inserted in a uniform manner and can be secured by chemical welding or hot welding.

The plastic used as the extrudant is prepared to withstand the exposure to the elements, thus preventing UV degradation. Colorant is possible if desired in certain architectural settings.

The advantages of the invention will be more fully appreciated by reference to the figures and drawings, a brief description of which follows, in conjunction with the following detailed description of the preferred embodiments of the invention.

DETAILED DESCRIPTION OF THE INVENTION

The invention has been illustrated and described in considerable detail, so that the configuration and advantages of the improved slotted drain may be readily appreciated by those skilled in the art. It will be understood, however, that various changes may be made in such details without departing from the spirit or scope of the invention.

Figure 1:
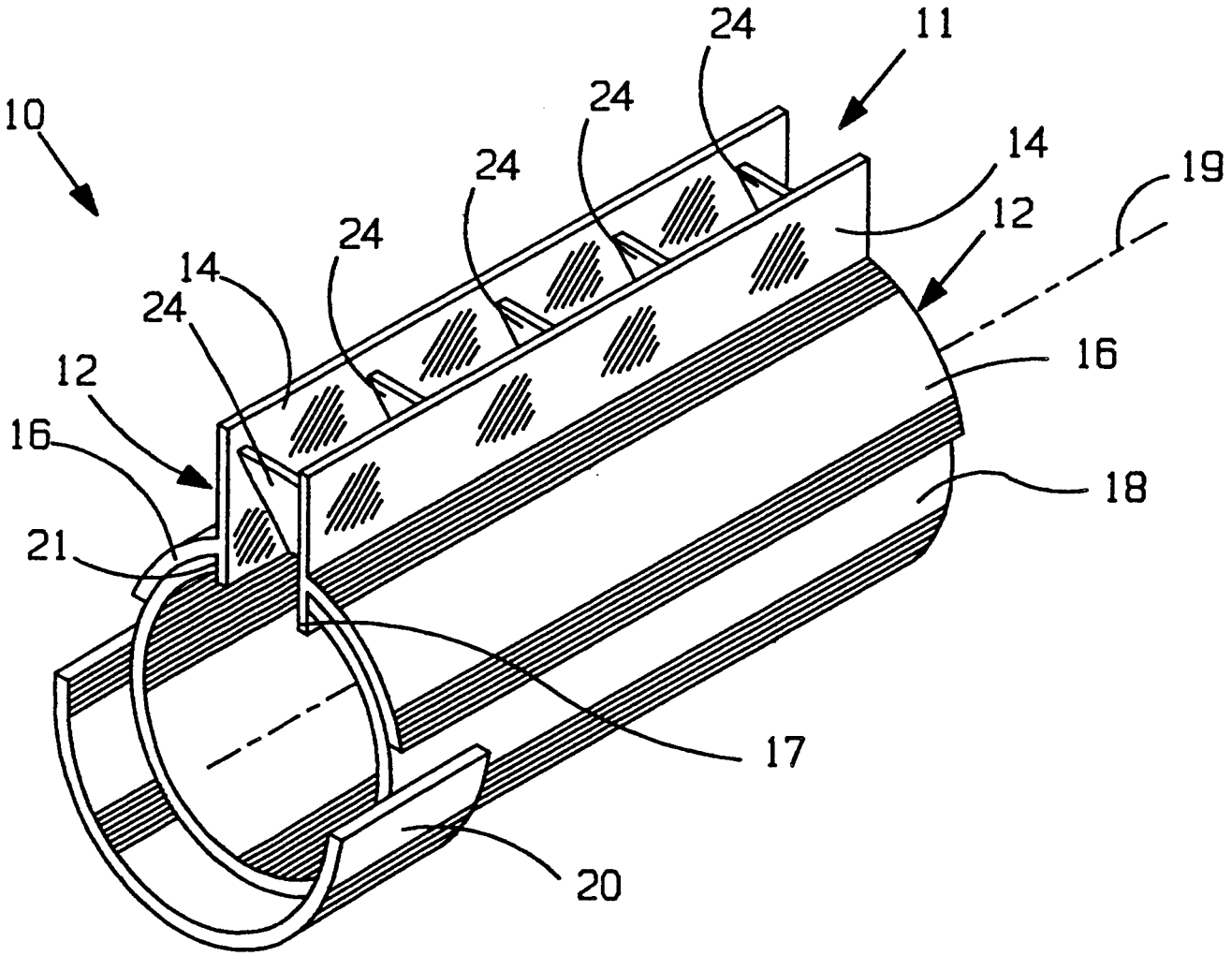
FIG. 1: A perspective view of the present invention.
Figure 3:
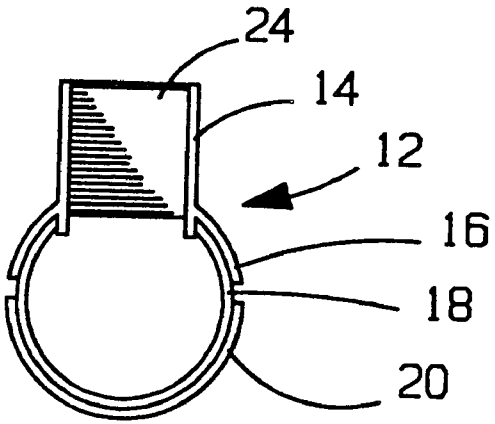
FIG. 3: A cross sectional view of FIG. 2 taken along Line AA
Figure 2:
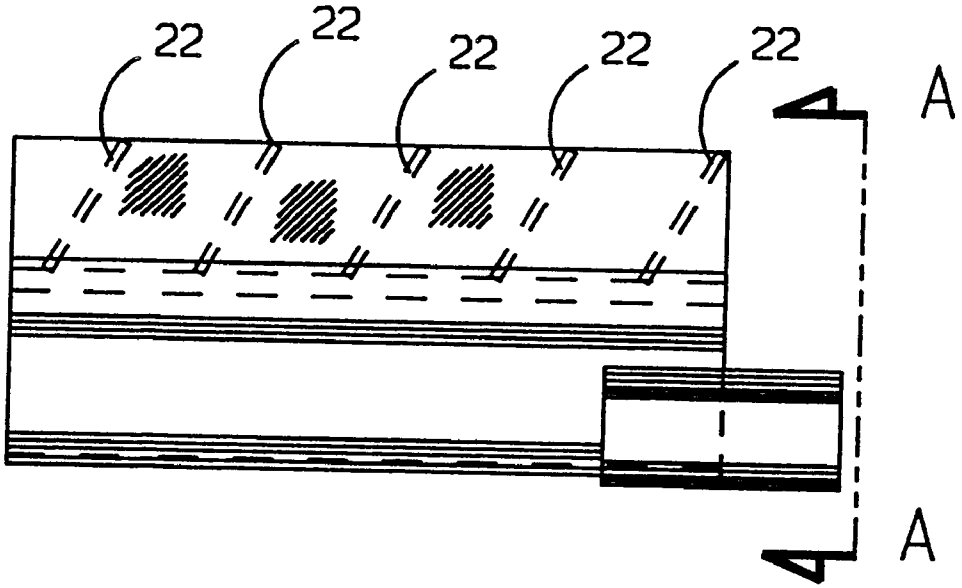
FIG. 2: A side view of the present invention.
Figure 4:
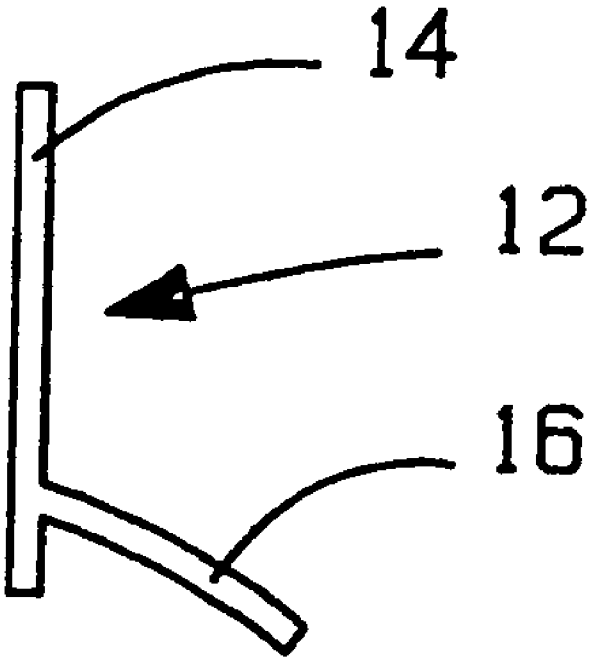
FIG. 4: An expanded view of the extruded plastic sections of the present invention.

As shown in FIG. 1, a drainage system (10) of the present invention include a carrier pipe (18) and an upper assembly (11). Plastic carrier pipe (18) has a longitudinal axis (19) and an elongated slot (21) extending lengthwise along the top of its surface. Upper assembly (11) includes two extruded plastic sections (12) connected by multiple spacers (24). Each extruded plastic section (12) consists of a vertical portion (14) and a curved portion (16). Curved portion (16) is positioned in such a manner as to create lower lip (17). Vertical portion (14) also includes multiple spacer grooves (22) as shown in FIG. 2. The vertical portion (14) has a bottom portion.

Upper assembly (11) is created by joining two extruded plastic sections (12) by placing multiple spacers (24) within the respective spacer grooves (22) of each extruded plastic section (12). Spacers (24) are secured to the extruded plastic sections (12) by either a chemical or hot welding process. An opening is created between the extruded plastic sections (12) so that water run-off can be collected in sheet flow within plastic carrier pipe (18).

Upper assembly (11) is secured to plastic carrier pipe (18) by placing lower lip (17) within the longitudinal slot (21) to the extent that curved portion (16) is in contact with the exterior upper surface of plastic carrier pipe (18). Upper assembly (11) is secured to plastic carrier pipe (18) by a chemical welding process. Self-tapping stainless steel screws may be used to hold upper assembly (11) in place during the curing time of the weld.

Drain assembly (10) can be made of various lengths depending upon the needs of the individual project. These individual sections are joined together by using a sleeve coupling (20) wherein two drain assembly (10) with a single sleeve coupling (20) secured to the exterior lower surfaces of both drain assemblies (10).

Figure 5B:
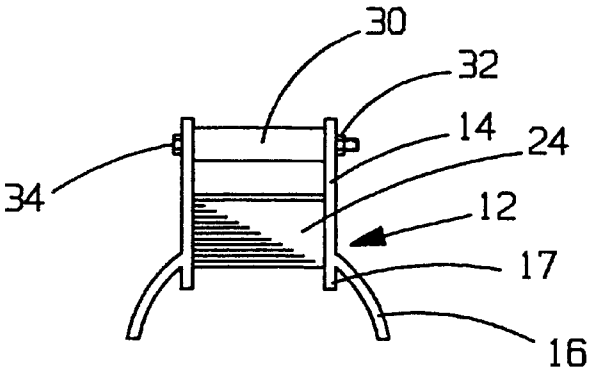
FIG. 5B: A cross section of FIG. 5A.
Figure 5A:
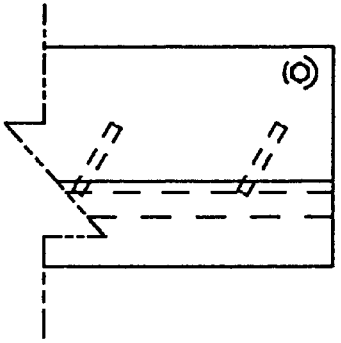
FIG. 5A: A side view of the second embodiment of the present invention.

In some instances a guard is needed to be placed over the opening created by the spacers (24) positioned between the extruded plastic sections (12). FIGS. 5A and 5B show an embodiment of this aspect of the present invention wherein the height of spacers (24) are less than the heights of vertical portion (14) of the extended extruded plastic sections (12). Further, a cylindrical spacer (30) is positioned near the top of horizontal portion (15) and secured to the vertical portion (14) by means of bolt (34) and securing nut (32). A guard is then able to rest upon cylindrical spacers (30).

Figure 6A:
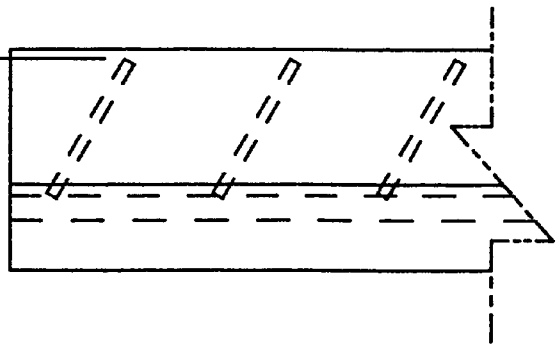
FIG. 6A: A side view of the third embodiment of the present invention.
Figure 6B:
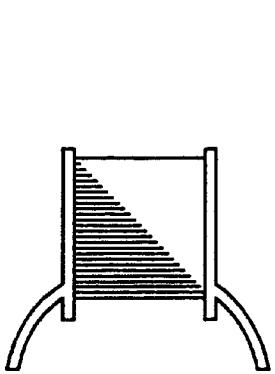
FIG. 6B: A cross section of FIG. 6A.

Referring now to FIGS. 6A and 6B, shows another embodiment of this portion of the invention wherein spacers (24) are just less than flush with the top of vertical portion (14). A guard is able to be placed on top of spacers (24).

Figure 7:
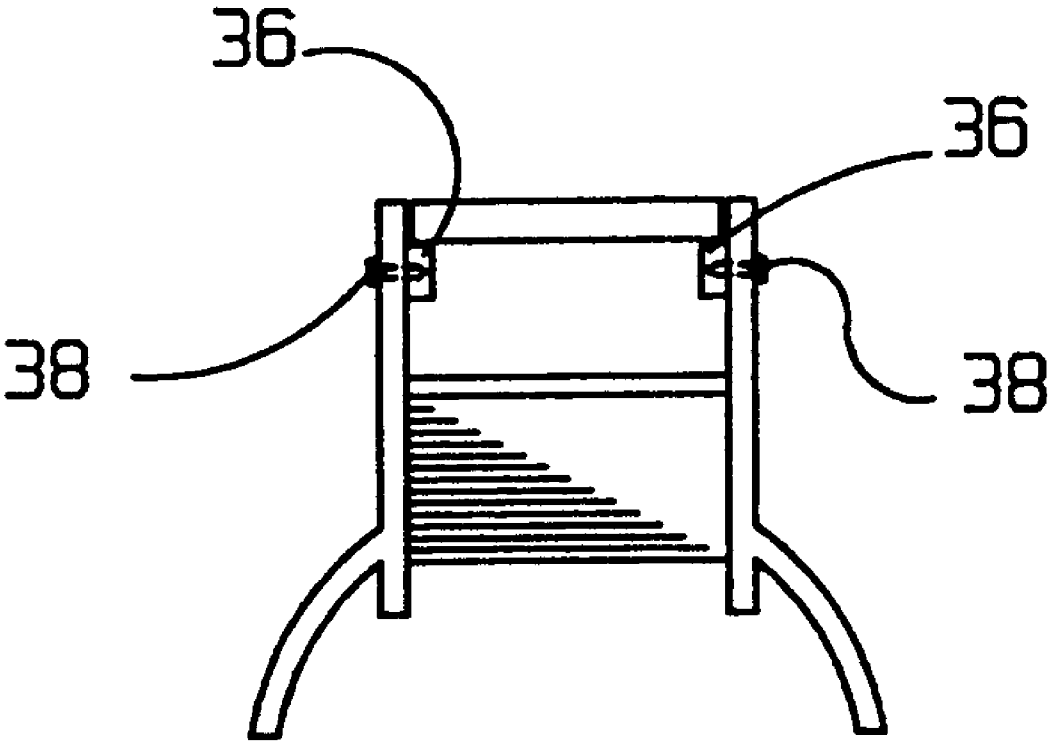
FIG. 7: A fourth embodiment of the extruded plastic section.
Figure 8:
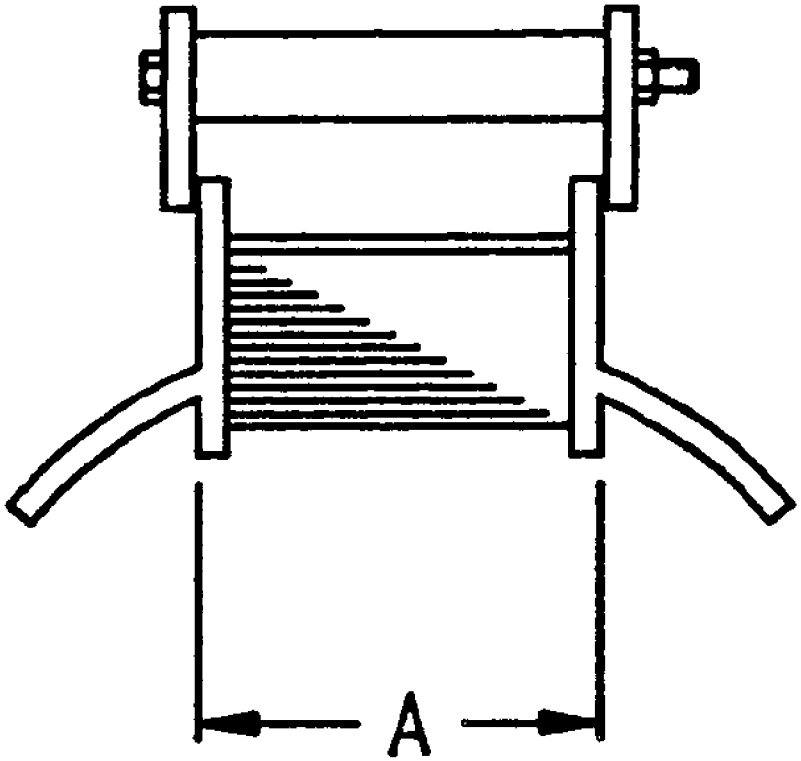
FIG. 8: A fifth embodiment of the extruded upper plastic section.

Referring now to FIG. 7 which shows an additional embodiment of the present invention which includes internal supports (36) which are connected to the internal walls of vertical portion (14) by means of self-tapping stainless steel screws (38). The internal supports (36) are located near the top of vertical portion (14) that allows for a guard to rest within the opening created by spacers (24).

While preferred embodiments of the present invention have been described above, various other modifications will become readily apparent to those of ordinary skill without departing from the scope of the invention. An applicant intends to be bound only by the claims appended hereto.

What is claimed is:

1. A pipe drain system comprising:

(A) a plastic carrier pipe having a diameter and a longitudinal access with an elongated slot extending lengthwise along the upper surface thereof; and (B) a grate assembly connected to said plastic carrier pipe through a chemical welding process, said grate assembly comprising:

(i) two extruded plastic sections, each extruded plastic section further comprising:

(a) a vertical portion having a top portion, a bottom portion, an interior surface and an exterior surface; and (b) a curved portion having a first end, an interior surface and an exterior surface; and (ii) a plurality of flat spacer units rigidly fixed by a chemical welding process or a hot welding process between the interior surfaces of each said vertical portion of the extruded plastic section, respectively.

2. The pipe drain system of claim 1 wherein the interior surface of said curved portion of each extruded plastic section is chemically welded to said upper surface of said plastic carrier pipe.

3. The pipe drain system of claim 1 wherein said spacer units are substantially parallel to one another.

4. The pipe drain system of claim 1 wherein a guard is attachable to said upper portion of said grate assembly in order to provide safety in foot traffic installations.

5. The pipe drain system of claim 1 wherein said interior surfaces of each said vertical portion of said extruded plastic sections includes grooves in which to seat said spacer units in position for chemical welding.

6. The pipe drain system of claim 1 wherein said curved portion is dimensioned to the diameter of carrier pipe and the lower section of vertical portion is compressed within the opposing edges of said elongated slot.

* * * * *